United States Patent [19]

Estes

[11] 4,252,106

[45] Feb. 24, 1981

[54] FIREPLACE GRATE ASSEMBLY

[76] Inventor: Richard B. Estes, 20 Sandra La., Athens, Ala. 35611

[21] Appl. No.: 66,925

[22] Filed: Aug. 16, 1979

[51] Int. Cl.[3] ..... F23H 13/00; F24B 7/00; F24F 3/14

[52] U.S. Cl. ..... 126/164; 126/121; 126/134; 126/163 R

[58] Field of Search ..... 126/164, 165, 163 R, 126/163 A, 152 R, 120, 121, 129, 131, 143, 135, 134; D7/207; D23/96; 237/51

[56] References Cited

U.S. PATENT DOCUMENTS

| | | | |
|---|---|---|---|
| 3,269,383 | 8/1966 | Maasberg | 126/164 |
| 3,905,351 | 9/1975 | Hatfield | 126/164 |
| 3,942,509 | 3/1976 | Sasser | 126/164 |
| 3,945,369 | 3/1976 | Adams et al. | 126/121 |
| 4,008,706 | 2/1977 | Buanno | 126/121 |
| 4,018,210 | 4/1977 | Christophel | 126/164 |
| 4,131,106 | 12/1978 | Rusinek et al. | 126/121 |
| 4,161,168 | 7/1979 | Cagle | D7/207 |
| 4,185,611 | 1/1980 | Johnson | 126/164 |
| 4,197,829 | 4/1980 | Pierce | 126/164 |
| 4,204,519 | 5/1980 | Towery | 237/51 |

FOREIGN PATENT DOCUMENTS

| | | | |
|---|---|---|---|
| 2715168 | 10/1978 | Fed. Rep. of Germany | 126/164 |

*Primary Examiner*—James C. Yeung
*Assistant Examiner*—Daniel O'Connor
*Attorney, Agent, or Firm*—C. A. Phillips

[57] ABSTRACT

A grate assembly consisting of a pair of tubular U-shaped grates with turned-down, front positioned ends coupled to receptacles in a base plate, which base plate extends across the front and inside of a fireplace. Two of these receptacles, one coupled to each grate, are connected to a blower positioned in a frontal cavity of a hearth in front of and below the fireplace. The other two of the receptacles, one connected to each grate, are connected to pipes which extend down through and to the front of the hearth. They exhaust heated air.

6 Claims, 6 Drawing Figures

FIREPLACE GRATE ASSEMBLY

BACKGROUND OF THE INVENTION

1. Field of the Invention

This invention relates to fireplace heating systems, and particularly to tubular grate systems where air is circulated through a grate.

2. General Description of the Prior Art

Since the era of fuel shortage commenced a few years ago, a great emphasis has been placed upon the use of wood as a source of heat. It followed that instead of fireplaces being used largely for decoration and aesthetic warmth, they should provide a significant amount of heat. Perhaps the first approach to the improvement of fireplace efficiency was to employ double walled fireplace liners and thus to, in effect, make something of a stove of a fireplace by circulating air through the double walls. Thousands of these have been made and used with considerable success. Considering that such units are fairly costly and somewhat difficult to install, other approaches and configurations of fireplace type heaters have evolved. Perhaps the most prominent of these has been to employ some form of tubular grate. The most common type of these employs a series of side-by-side pipe loops, each lying in a vertical plane and wherein cool air enters lower ends of the loops and heated air exits at higher positioned ends of the loops.

For effectiveness, it is pretty much required that a glass screen be employed over a fireplace opening if much heat is to be obtained from a fireplace. This then meant that with tubular grates, pipes would have to extend through the glass screen. As a further adjunct, room air is typically forced through tubular grates by a blower which, for lack of any other place to put it, typically rests on a hearth in front of the fireplace. This is both unsightly and noisy.

Considering the foregoing, it is the object of this invention to provide an improved fireplace heater which may be used with any fireplace screen, where there are no air pipes passing through the fireplace opening, and while employing a blower, the blower is located so as to be unobtrusive and to cause little room noise.

DESCRIPTION OF THE PREFERRED EMBODIMENT

Figure 1:
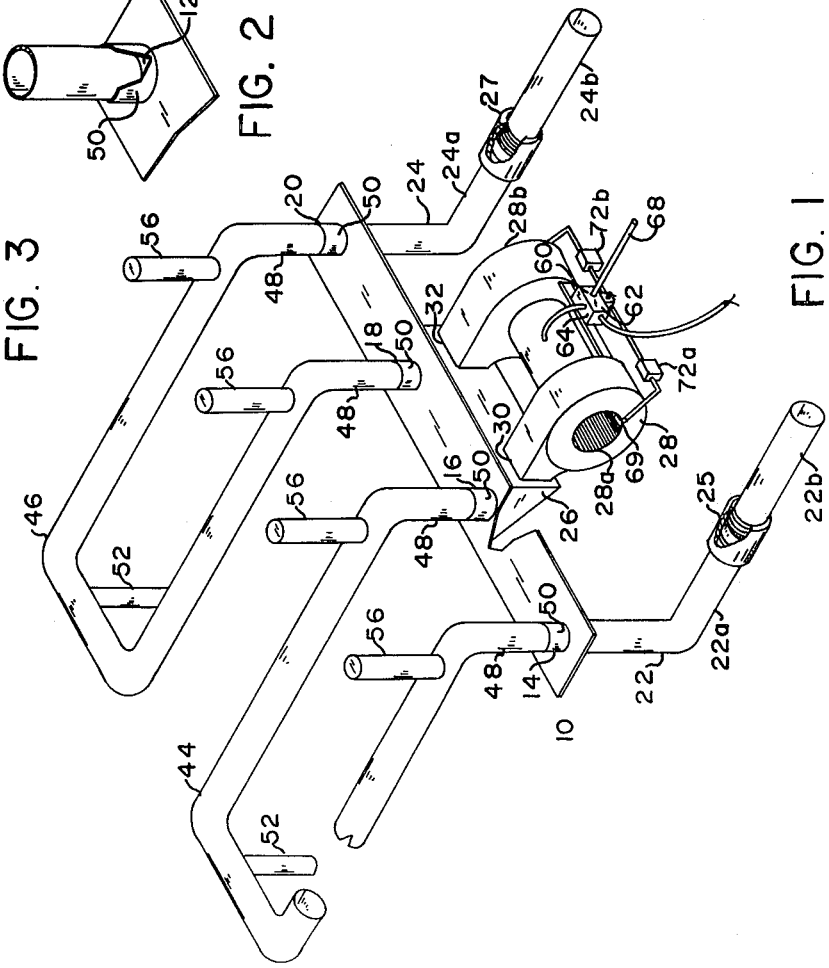
FIG. 1 is a pictorial view of a grate assembly as contemplated by this invention.

Base plate 10 is constructed with four openings 12 (FIG. 2) at locations 14, 16, 18, and 20 (FIG. 1). L-shaped pipes 22 and 24 attach to openings 12 at locations 14 and 20. A plenum 26 is positioned on the underside of plate 10, which plenum is coupled to openings 12 at locations 16 and 18 of plate 10. A blower 28 has outlets 30 and 32 coupled to plenum 26.

Figure 4:
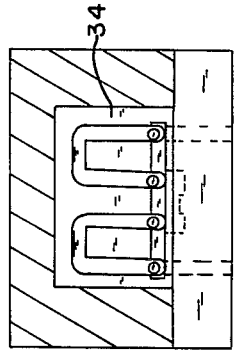
FIG. 4 is a top view of a grate assembly.
Figure 5:
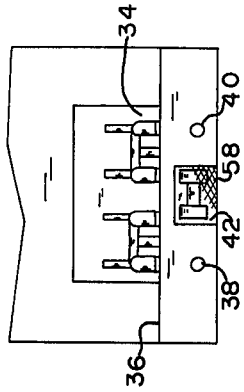
FIG. 5 is a front view of a grate assembly.
Figure 3:
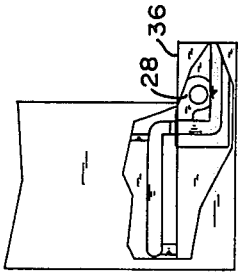
FIG. 3 is a side installation view of a grate assembly.
Figure 2:
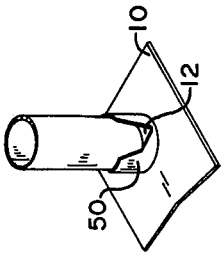
FIG. 2 is a pictorial view of a detail of construction of FIG. 1.

FIGS. 2–4 illustrate the installation of the structure thus far described wherein plate 10 is positioned across the front and floor of fireplace 34, pipes 22 and 24 extending through hearth 36, terminating in ends 38 and 40 at the front of hearth 36. These pipes are adjustably extended by making each pipe in two sections, sections **22*a* and 22*b* and sections 24*a* and 24*b*, respectively. Sections 22*a* and 22*b* have adjacent threaded ends and are connected by threaded coupling 25 whereby the overall length of pipe 22 is adjustable, and sections 24*a* and 24*b* are similarly constructed and adjusted by threaded coupling 27 (the couplings are broken for purposes of illustration). In this way, variations in hearth depth may be compensated for. Blower 28 is positioned in front cavity 42 of hearth 36, typically being located some distance back in cavity 42 as shown in FIG. 3**.

Grates 44 and 46 are generally U-shaped and formed of steel tubing or pipe having an internal diameter of two to four inches and a wall thickness of 0.154 to 0.375 inch. Ends of turned-down end regions 48 of the grates fit, as shown in FIG. 2, in flange receptacles 50 positioned over openings 12 in plate 10. Turned-down end regions 48 of the grates and rear support members 52 together effect a generally horizontal support for each grate. Upstanding rods or pipes 56 prevent logs from falling off the front portion of the grates.

By virtue of the basic arrangement of the invention, with plate 10 just inside fireplace 34 and thus providing for air flow through hearth 36, a fireplace screen can be placed over the front of the fireplace without interference of the system of the invention, and no special fireplace screen is required. The grates, which are subject to corrosion and oxidation, will in time wear thin. This presents no problems since they frictionally couple to receptacle flanges 50 and may be readily removed and replaced. Similarly, blower 28 is accessible and can be repaired or replaced without difficulty.

As a further feature of this invention, blower 28 is positioned back in cavity 42. It is thus obscured from view, and the blower presents little room noise. Further, improvements in these respects are achieved by placing a porous material, such as an open cell foam of woven fiberglass material, over the front of cavity 42 in the form of a cover 58. In addition to further reducing noise from blower 28, the cover effects filtration of air drawn into the blower and thus removes dust particles.

Figure 6:
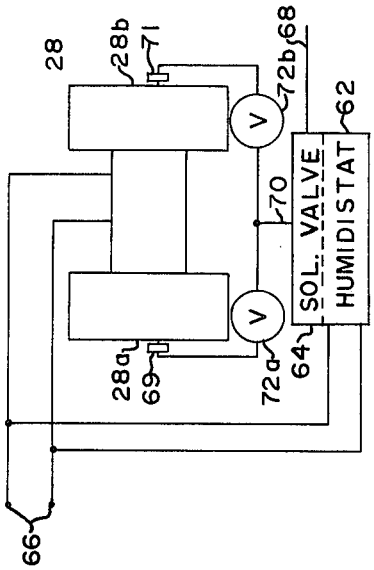
FIG. 6 is a schematic illustration of the electrical and fluid lines of the grate assembly.

As still a further feature of this invention, means are provided for adding, or adding and controlling, humidity to the air flowing through the system. As illustrated in FIGS. 1 and 6, humidity control 60, consisting of a humidistat (humidity sensitive switch) 62, and solenoid valve 64 control the introduction of water to blower 28. Thus, humidistat 62 controls electrical power supplied from electrical lines 66 to solenoid valve 64, the latter being connected in a fluid path between source water line 68 and water line 70. Flow is then to needle valves **72*a* and 72*b* which balance flow to mist nozzles 69 and 71, respectively. The mist nozzles transform flow to a mist form which is directed to inlets 28*a* and 28*b* of blower 28. Thus, in operation, with power applied to terminals 66 and thus energizing blower 28, power will be available to operate solenoid valve 68 through humidistat 62. In operation, responsive to a selected humidity setting of humidistat 62, it senses a lower than selected level of humidity in the air passing by it and turns on solenoid valve 68** until the humidity level is raised to a selected value. Often in the winter in many localities, relative humidity of room air may run as low as 10%. By increasing relative humidity of the inlet air to approximately 90%, the efficiency of heat transfer from the grates to the air passing through it is substantially improved. This also increases the relative humidity and thus comfort level of room air in general.

All considered, the combination of features of this invention provides a truly improved heating system which is, while being attractive and quiet, most effective. As an example, in tests run with it in a fireplace having a width of 36 inches, a depth of 28 inches, and with a 2.076-inch size (inner diameter) pipe for grates 44 and 46, and with a fireplace screen over the front of the fireplace, a moderately hot fire was found to provide a heat output of approximately 60,000 BTUs per hour. In this test, the inlet air temperature was approximately 70° F., with a relative humidity of 90% (after water injection); the outlet air temperature was approximately 350° F., with a relative humidity of 30%. The volume of air passing and exiting through the grates was approximately 250 cubic feet per minute. Room air was generally maintained at approximately 70° F., with a relative humidity of 50%.

Having thus described my invention, what is claimed is:

1. A fireplace grate assembly comprising:

an elongated horizontal base plate adapted to extend across the front, inside, of the floor of a fireplace;

a plurality of vertically extending spaced openings through said base plate, including first, second, third, and fourth said openings spaced, in that order, along said plate;

a receptacle positioned around each said opening;

first and second, side-by-side, U-shaped tubular grates adapted to generally extend horizontally and rearwardly into a fireplace, and each having a pair of down-turned open ends adapted to mate with receptacles of a pair of adjacent said openings;

a rear support extending downwardly from a rear portion of each said grate, which support, together with a pair of said down-turned ends, supports a said grate generally horizontally;

down-turned ends of said first grate being connected to receptacles around said first and second openings, and said down-turned ends of said second grate being connected to receptacles around said third and fourth openings;

first and second air exit pipes, each being adapted to extend downwardly and outwardly to a wall interface outside of the fireplace, one of said pipes being connected to an opening, which in turn is coupled to a said receptacle to an end of one of said grates, and the other of said pipes being connected to a said opening which is coupled by a said receptacle to an end of the other of said grates; and blower means for drawing air from an air space outside of a fireplace and applying it under pressure to openings in said plates not directly connected to said exit pipes;

whereby air from a space to be heated is drawn in by said blower means and forced through said grates as heated air exits through said pipes.

2. An assembly as set forth in claim 1 including a hearth in front of and below said fireplace, and said pipes extend outwardly through said hearth, and said hearth has a frontal cavity in which said blower means is positioned.

3. An assembly as set forth in claim 2 further comprising humidity means coupled to said blower means for adding moisture to air drawn in by said blower means.

4. An assembly as set forth in claim 3 wherein said humidity means includes humidity control means responsive to moisture content of air drawn through said cavity for selectively adding moisture to air supplied to said grates as a function of sensed moisture content of inlet air.

5. An assembly as set forth in claim 3 further comprising filter means positioned over said frontal cavity for reducing dust flow into said cavity and noise transmission out of said cavity.

6. An assembly as set forth in claim 3 wherein the outwardly extending portions of said pipes are adjustable in length.

* * * * *